United States Patent [19]

Brunel

[11] 4,334,369

[45] Jun. 15, 1982

[54] SKI-SHOE

[76] Inventor: Paul H. Brunel, "Le Meleze"-Residence Charriere Blanche, Ecully (Rhone), France

[21] Appl. No.: 183,924

[22] Filed: Sep. 3, 1980

[30] Foreign Application Priority Data

Sep. 5, 1979 [FR] France ..... 79 22722

[51] Int. Cl.[3] ..... A43B 5/04

[52] U.S. Cl. ..... 36/124

[58] Field of Search ..... 36/122, 123, 124, 125

[56] References Cited

U.S. PATENT DOCUMENTS

| | | | |
|---|---|---|---|
| 3,600,829 | 8/1971 | LaViolette | 36/124 |
| 3,755,927 | 9/1973 | Dearborn | 36/124 |
| 3,802,100 | 4/1974 | Prater | 36/124 |

*Primary Examiner*—Patrick D. Lawson

*Attorney, Agent, or Firm*—Karl F. Ross

[57] ABSTRACT

A ski-shoe for traveling on snow has an elongated generally flat base plate having an upwardly curved front end and a pair of longitudinally extending side edges. Respective upright sides extending the full length of the base plate have lower edges joined to the side edges of the base plate. A pair of side rails extending outwardly and downwardly from the upper edges of the sides and having lower edges lying above the base plate form downwardly open channels with the respective sides. The foot of the user is secured to the base plate between its front and rear ends and between these sides. At least one flap is pivotal underneath the base plate between an axis lying ahead of the flap between an upper position lying generally against the base plate and a down position extending transversely downwardly from the base plate. The sides, rails, and base plate all are made integrally of a synthetic resin and the device has an overall length of less than 1 meter.

10 Claims, 4 Drawing Figures

SKI-SHOE

FIELD OF THE INVENTION

The present invention relates to an article of footwear usable for moving on snow.

BACKGROUND OF THE INVENTION

Two basic types of footwear exist for moving on snow: snowshoes and skis, both adapted and developed over the years for specific circumstances.

Skis are intended mainly for sliding on snow, normally downhill. It is possible to adapt them for cross-country use and even for uphill travel by the provision of special devices which prevent the skis from sliding backwardly. At best, however, skis are relatively difficult to master, bulky, and expensive. Only after quite some experience can the average person use skis well enough to make any serious progress on snow.

Snowshoes are somewhat easier to employ, but do not allow any sliding, even for downhill travel. Snowshoes are extremely fatiguing to wear and do require some experience. Like skis, snowshoes are also relatively expensive items that have little interest for the casual winter sportsperson.

OBJECTS OF THE INVENTION

It is therefore an object of the present invention to provide an improved article of footwear—a ski-shoe—which combines the advantages of skis and the advantages of snowshoes while avoiding the disadvantages of both.

Another object is to provide such a ski-shoe whose use can be easily mastered, and which can be produced at relatively low cost so as to be of use even to the casual winter sportsperson.

SUMMARY OF THE INVENTION

These objects are attained according to the instant invention in a ski-shoe having an elongated and generally flat base plate having an upwardly curved front end, a rear end, and a pair of longitudinally extending side edges. Respective upright sides extend the full length of the base plate and have lower edges joined to the side edges. A pair of side rails extend outwardly and downwardly from the upper edges of the sides and have lower edges lying above the base plate. Thus these side rails form downwardly open channels with the respective sides. Means such as straps are provided for securing the foot of the user to the base plate between the ends thereof and between the sides. At least one flap is mounted pivotally underneath the base plate and pivot means is provided for pivotal movement of this flap relative to the base part of the sides about a horizontal axis transverse to the sides between an up position lying generally against the base plate and a down position extending transversely downwardly from the base plate. The base plate, side, and rail of such a ski-shoe are formed integrally of a durable synthetic resin, with an overall length of between 60 cm and 100 cm, depending on the size of the user. With such an arrangement it is possible for the user to be supported on even relatively powdery snow by the relatively great surface area of the ski-shoe in the same manner as a standard snowshoe supports its user. Like a ski and unlike a snowshoe, however, it is possible for the user to move forwardly by sliding his or her foot, with backward sliding being impeded by the pivotal flap. In relatively hard snow the ski-shoe according to this invention will ride entirely on the lower surface of the base plate. For soft or very powdery snow the ski-shoe will sink in somewhat and will ride also on the underside of the downwardly open channels formed between the sides and the rail, providing extra surface area with the rail serving to guide the ski-shoe longitudinally.

According to further features of this invention the lower adges of the rail join the front end of the base part smoothly and without interruption. Thus the entire apparatus can slide smoothly through the snow much like a small toboggan secured to the user's foot. The sides, rails, and base part are integrally formed with substantially the same wall thickness. They are made of a durable synthetic resin so that they can be very light.

According to further features of this invention respective second flaps and second pivot means distinct from the first-mentioned flap and pivot means are provided in the channels. To this end each of the sides is formed with an inwardly projecting portion forming outwardly open recesses receiving the respective second flaps. These recesses are formed as the means for securing and define between themselves a gap having a dimension of between 20 cm and 40 cm so that the foot of the user can be snugly wedged in place at this location. Similarly the base part is formed with at least one downwardly open recess in which the respective first flap is recived.

According to further features of this invention two such first flaps are provided on the base plate and each has a rear edge remote from its axis and formed with a three-dimensional projection extending downwardly in the up position. Thus during hill climbing or the like any slight backwards sliding will catch this three-dimensional projection and pivot the flap into the down position so as completely to impede any further backward sliding. Means may also be provided for locking this flap in the down position for use of the ski-shoe in accordance with this invention on ice.

Each of the first flaps, according to this invention, has a substantially planar central part having a pair of lateral edges and a pair of upstanding lips that flank the sides and extend upwardly in the up position from the lateral edges. The axis extends through these sides and through these lops above the base part. Thus each flap will be a relatively rigid body that can be secured or pivoted and only displaceable through approximately 90°, as in the down position the leading or upper edge of the flap will engage in line contact against the base plate and effectively block further pivoting.

SPECIFIC DESCRIPTION

Figure 1:
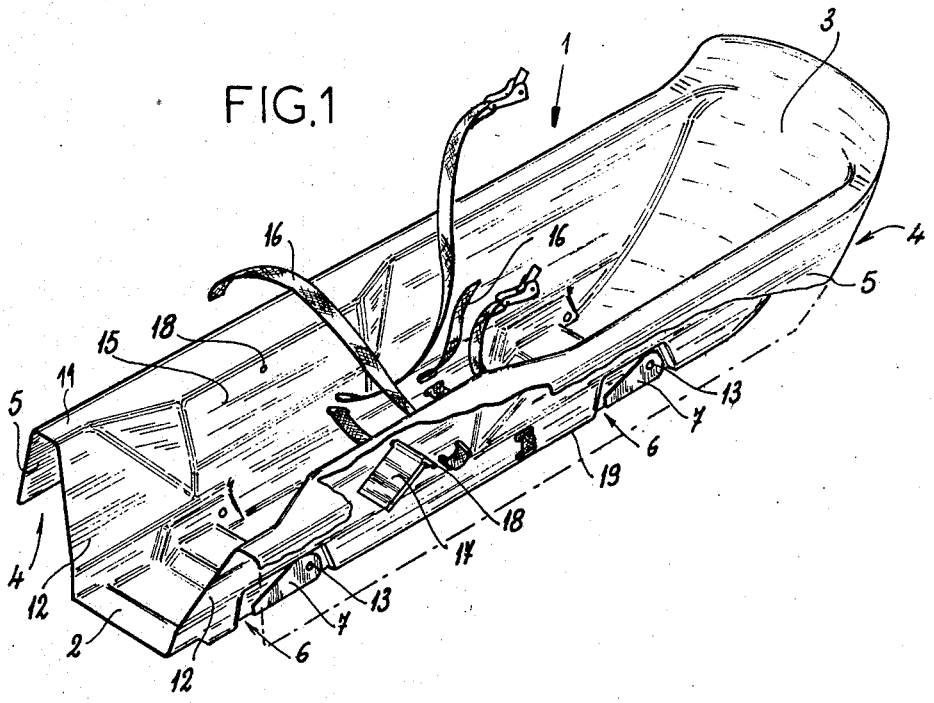
FIG. 1 is a perspective view partly broken away showing a ski-shoe according to the instant invention.

As seen in FIG. 1 a ski-shoe 1 according to the instant invention basically has a generally planar base plate 2 that is curved upwardly like a ski or toboggan at its front end 3. Secured to side edges of this base plate 2 are a pair of upstanding sides 12 from whose upper edges extend rails constituted by an outwardly horizontally extending strip 11 and a downwardly extending strip 5 together forming on each side of the base part 2 a downwardly open U-section channel 4. At their front portions the strips 11 and 5 smoothly join the front end 3 without interruption. At their rear ends base part 2, side 12, strips 11 and 5 all terminate in a plane P transverse to the normal forward direction D of displacement of the ski shoe 1 and tilted slightly forwardly. The lower edges of the vertical outer strips 5 of the channels 4 lie well above the base plate 2.

Figure 2:
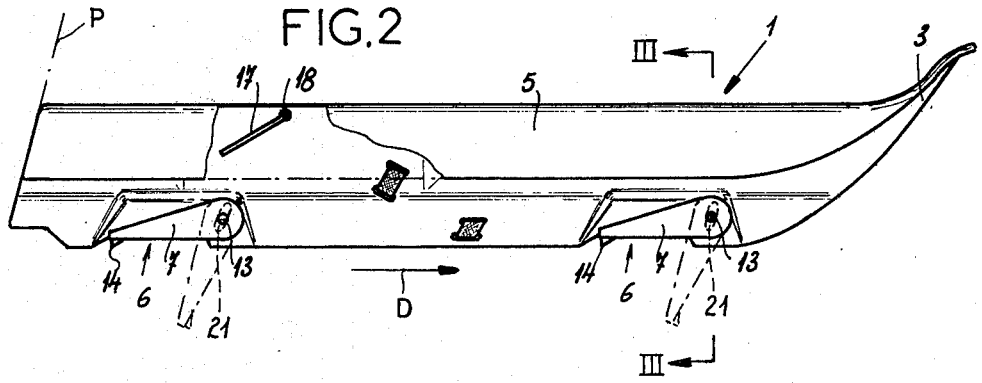
FIG. 2 is a side view partly broken away of the ski-shoe of FIG. 1.
Figure 3:
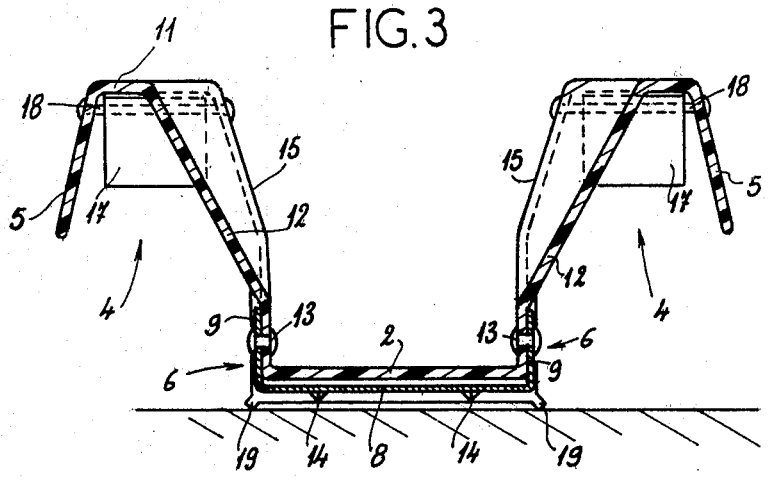
FIG. 3 is a section taken along line III—III of FIG. 2.
Figure 4:
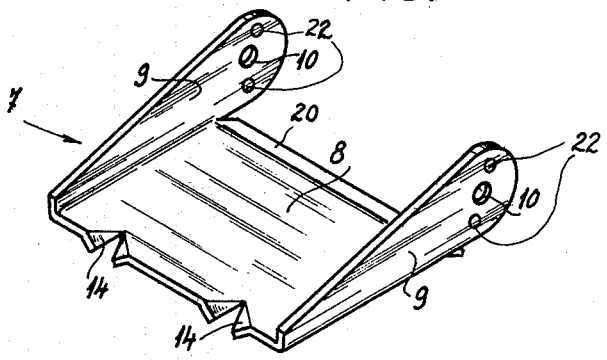
FIG. 4 is a perspective view of a first flap of the apparatus according to this invention.

The base plate 2 is formed with a pair of longitudinally spaced and downwardly open recesses 6, each receiving a respective flap 7 normally constituted of sheet metal and having a planar central portion or plate from which extend two upwardly bent lips 9, each formed with a throughgoing pivot hole 10. These lips 9 flank the sides 12 and rivets 13 form pivots for the flaps 7. At their rear edges each of these flaps 7 has a three-dimensional projection 14 formed by cutting a slit perpendicular to the rear edge and bending down the plate 8 to each side of the slit. At its front edge 20 each of the plates 8 is bent down somewhat so that when in the dot-dash down position of FIG. 2 these edges 20 flatly engage the lower surface of the base plate 2 to prevent further counterclockwise pivoting about the pivot 13. Thus each of the flaps 7 can move through slightly less than 90° about the respective pivot 13.

In addition each of the side walls 12 is formed approximately two-thirds of the way from the front end 3 to the plane P with an inwardly-projecting portion 15. These portions 15 define a transverse width between 20 cm and 40 cm, as compared to an overall length of between 60 cm and 100 cm for the ski-shoe 1. Straps 16 threaded through these portions 15 allow the foot of the user to be securely held in place, normally wedged between portions 15 of the sides 12.

In addition pivoted in each of the strips 5 and each of the side walls 12 at the portion 15 is another flap 17 movable through approximately 90° about a respective pivot 18. A simple formation on each of the flaps 17 prevents it from pivoting forwardly from a position substantially perpendicular to the base plate 2, it being, of course, possible for each of the flaps 17 to pivot up flatly against the respective strip 11.

The corners between the outer edges of the base plate 2 and the lower edges of the sides 12 are each formed with an outwardly projecting rib 19 extending longitudinally of the ski-shoe 1 and serving to guide it in the snow and rigidify the structure. Furthermore it is possible to provide U-shaped clips 21 which engage through holes 22 in the lips 9 and through corresponding holes in the side 12 to secure the flaps 7 in the dot-dash down position of FIG. 2. This makes it possible to use the ski-shoe 1 according to the instant invention like a crampon on ice.

Thus it is possible for a relatively casual winter sportsperson to travel on snow with considerable ease using the devices according to the instant invention. As they are substantially shorter than normal skis mastering their use is relatively simple. On hard snow they will ride almost exclusively on the base part 2. On softer snow, however, they will sink in until the snow comes up to the undersides of the strips 11, providing extra surface area and allowing the flaps 17 to function. During downhill travel the flaps 7 and 17 will extend parallel to the direction D, but they will effectively prevent any backward slipping during upward or level traveling.

The ski-shoe 1 according to the instant invention can be readily produced at relatively low cost from a synthetic resin such as nylon. Ski-shoes 1 are all identical for both feet and require little adjustment of the straps 16 for use by different people.

I claim:

1. A ski-shoe comprising:

an elongated and generally flat base plate having an upwardly curved front end, a rear end, and a pair of longitudinally extending side edges;

respective upright sides extending the full length of said base plate having lower edges joined to said side edges and upper edges;

a pair of side rails extending outwardly and downwardly from said upper edges of said sides and having lower edges lying above said base plate, said side rails forming downwardly open channels with the respective sides;

means for securing the foot of a user to said base plate between said ends and between said sides;

at least one flap underneath said base plate; and pivot means for mounting said flap for pivotal movement about a horizontal axis transverse to said sides between said flap and said front end relative to said base part and sides between an up position lying generally against said base plate and a down position extending transversely downwardly from said base plate.

2. The ski-shoe defined in claim 1 wherein said lower edges of said rails join said front end of said base part smoothly and without interruption.

3. The ski-shoe defined in claim 2 wherein said sides, rails, and base part are integrally formed and of substantially the same wall thickness.

4. The ski-shoe defined in claim 2, further respective second flaps and second pivot means distinct from the first-mentioned flap and pivot means and provided in said channels.

5. The ski-shoe defined in claim 2 wherein said base part is formed with at least one downwardly open recess, said flap being received in said recess in said up position.

6. The ski-shoe defined in claim 2 wherein said sides are formed with inwardly projecting portions forming outwardly opening recesses at said means for securing, said portions serving for wedging said foot.

7. The ski-shoe defined in claim 2 wherein said flap has a rear edge remote from said axis and formed with a three-dimensional projection extending downwardly in said up position.

8. The ski-shoe defined in claim 2, further comprising means for locking said flap in said down position.

9. The ski-shoe defined in claim 2 wherein each of said flaps has a substantially planar central part having a pair of lateral edges and a pair of upstanding lips flanking said sides and extending upwardly in said up position from said lateral edges, said axis extending through said sides and through said lips above said base part.

10. The ski-shoe defined in claim 2 wherein said base part has an overall length between its said ends of between 60 centimeters and 100 centimeters.

* * * * *